US008303420B2

(12) United States Patent
Chudek et al.

(10) Patent No.: US 8,303,420 B2
(45) Date of Patent: Nov. 6, 2012

(54) WAGERING GAME MACHINES WITH UNIVERSAL MOUNTING BASE FOR LIGHT AND MARQUEE ASSEMBLIES

(75) Inventors: Christopher W. Chudek, Evanston, IL (US); David K. Rifkin, Little Egg Harbor, NJ (US); Thomas F. Costanzo, Elmhurst, IL (US); Michael R. Lewis, Las Vegas, NV (US); Sean E. Hayes, Arlington Heights, IL (US)

(73) Assignee: WMS Gaming Inc., Waukegan, IL (US)

( * ) Notice: Subject to any disclaimer, the term of this patent is extended or adjusted under 35 U.S.C. 154(b) by 55 days.

(21) Appl. No.: 13/021,850

(22) Filed: Feb. 7, 2011

(65) Prior Publication Data

US 2011/0207530 A1 Aug. 25, 2011

Related U.S. Application Data

(60) Provisional application No. 61/308,145, filed on Feb. 25, 2010.

(51) Int. Cl.
*A63F 9/24* (2006.01)

(52) U.S. Cl. ..... 463/46

(58) Field of Classification Search ..... 463/46
See application file for complete search history.

(56) References Cited

U.S. PATENT DOCUMENTS

| | | | |
|---|---|---|---|
| 4,440,457 | A | 4/1984 | Fogelman et al. |
| 4,718,672 | A | 1/1988 | Okada |
| 4,865,322 | A | 9/1989 | Krutsch |
| 5,110,120 | A | 5/1992 | Smolucha |
| 5,544,728 | A | 8/1996 | Dabrowski |
| 5,788,573 | A | 8/1998 | Baerlocher et al. |
| 5,813,914 | A | 9/1998 | McKay et al. |
| 5,823,874 | A | 10/1998 | Adams |
| 6,068,101 | A | 5/2000 | Dickenson et al. |
| 6,135,884 | A | 10/2000 | Hedrick et al. |
| 6,164,645 | A | 12/2000 | Weiss |
| 6,254,481 | B1 | 7/2001 | Jaffe |
| 6,270,411 | B1 | 8/2001 | Gura et al. |
| 6,315,660 | B1 | 11/2001 | DeMar et al. |
| 6,322,309 | B1 | 11/2001 | Thomas et al. |
| 6,475,087 | B1 | 11/2002 | Cole |
| 6,537,152 | B2 | 3/2003 | Seelig et al. |
| 6,758,473 | B2 | 7/2004 | Seelig et al. |
| 7,341,511 | B2 | 3/2008 | Fiden et al. |

(Continued)

FOREIGN PATENT DOCUMENTS

| | | | |
|---|---|---|---|
| EP | 0 886 250 | A1 | 12/1998 |

(Continued)

*Primary Examiner* — Omkar Deodhar
(74) *Attorney, Agent, or Firm* — Nixon Peabody LLP

(57) ABSTRACT

Wagering game systems, gaming machines, and methods of changing the appearance of a gaming machine are presented herein. In one embodiment, a gaming machine for playing a wagering game is presented. The gaming machine includes a display for displaying the outcomes of the wagering game, and an input device for receiving wagers from players. The gaming machine also includes a cabinet with a mounting base integrated to the top of the cabinet. The mounting base is configured to support any of a plurality of different top-box mounted fixtures, such as tower lights, marquees, and other signage. In some embodiments, the gaming machine also includes at least one electrical connector that is accessible from the exterior of the cabinet. The electrical connector is configured to electrically couple the selected top-box mounted fixture to the cabinet.

27 Claims, 10 Drawing Sheets

U.S. PATENT DOCUMENTS

| | | | | |
|---|---|---|---|---|
| 2003/0027627 | A1 | 2/2003 | Cole | |
| 2004/0023556 | A1 | 2/2004 | Smith | |
| 2005/0003886 | A1 | 1/2005 | Englman et al. | |
| 2005/0054449 | A1 | 3/2005 | Kopera et al. | |
| 2005/0215325 | A1* | 9/2005 | Nguyen et al. | 463/46 |
| 2005/0261057 | A1 | 11/2005 | Bleich et al. | |
| 2006/0277805 | A1 | 12/2006 | Kopera et al. | |

FOREIGN PATENT DOCUMENTS

| | | | |
|---|---|---|---|
| GB | 2 136 255 | A | 9/1984 |
| WO | 03/028829 | A1 | 4/2003 |
| WO | 2005/029220 | A2 | 3/2005 |

* cited by examiner

WAGERING GAME MACHINES WITH UNIVERSAL MOUNTING BASE FOR LIGHT AND MARQUEE ASSEMBLIES

CROSS-REFERENCE AND CLAIM OF PRIORITY TO RELATED APPLICATION

This application claims the benefit of and priority to U.S. Provisional Patent Application No. 61/308,145, which was filed on Feb. 25, 2010, and is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present disclosure relates generally to wagering game machines and gaming systems. More particularly, the present disclosure relates to tower lights, marquee displays, and other cabinet mounted fixtures for wagering game machines.

BACKGROUND

Gaming machines, such as slot machines, video poker machines, and the like, have been a cornerstone of the gaming industry for several years. Generally, the popularity of such machines with players is dependent on the likelihood (or perceived likelihood) of winning money at the machine, as well as the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Consequently, shrewd operators strive to employ the most entertaining and exciting machines, features, and enhancements available because such machines attract frequent play and, hence, increase profitability to the operator.

Many gaming machines include a variety of visual attractions and displays, such as models, signs, and other forms of information. These items typically include fixed permanently-printed glass, video displays, artwork, models, and marquees. In many gaming regions, industry regulations in fact require each gaming terminal to include top-box mounted lighting and signage that indicate, for example, the class of machine, when the machine is of out of funds, when the machine is malfunctioning, etc.

Historically, each gaming machine was limited to a single game with a dedicated top box display and top-box mounted marquee. To alter game offerings, casino operators or contracted technicians were therefore required to replace the entire gaming machine or the entire top box display and marquee. The replacement process is costly, time consuming, and counter-productive to maintaining pace with the continuously changing gambling industry.

In response, many gaming machine manufacturers, especially those that produce video-based gaming machines, have developed a basic gaming terminal (e.g., one that is universal to all their game offerings) that allows multiple games to be presented on the same machine, allowing easy conversion to a new game. For instance, if a casino operator decides that a certain video reel slot game, using a particular molded marquee, has reached the end of its useful playing life on the casino floor, the operator contacts the manufacturer and requests a conversion of the gaming machine to a newer, perhaps more popular game. The conversion of the main video-based wagering game is a simple task, merely requiring the change of software and perhaps surface artwork.

The marquee typically requires a complete replacement. This can be time-consuming, cumbersome, expensive, and also result in obsolete parts. In many cases, converting a gaming machine, which requires replacement of the top box display and marquee, typically necessitates at least two service technicians to manage the weight of the top box. Time and labor costs are further compounded by the complexity in electrically disconnecting and physically dismounting the previous marquee, and subsequently connecting and mounting the new marquee. Often times, the technician is required to run electrical cabling from the marquee, down through an opening in the crown and through the top box to the base cabinet. This often requires opening and dismantling a significant portion of the gaming terminal to complete the electrical connections.

SUMMARY

To make top-box lighting and marquee mounting, conversions, and repairs faster, easier, and more cost effective, the use of a common mounting interface in accordance with the aspects of the present disclosure would reduce variations in the mounting mechanisms in top-box mounted display offerings, simplify the conversion and repair process, and reduce the time and effort required to attach/remove the marquee of a gaming machine.

According to one aspect of the present disclosure, a gaming machine for playing a wagering game is featured. The gaming machine includes one or more displays configured to display the outcomes of the wagering game, and at least one wager input device configured to receive wagers from players for playing the wagering game. The gaming machine also includes a cabinet with a mounting base integrated to the top of the cabinet. The mounting base is configured to support any of a plurality of different top-box mounted fixtures, such as tower lights, marquees, and other signage.

According to another aspect of the present disclosure, a gaming system is provided for playing one or more wagering games. In this embodiment, the gaming system includes one or more displays for displaying outcomes of the wagering game(s), the outcomes being randomly selected from a plurality of wagering game outcomes. The gaming system also includes at least one player input device configured to receive play input from players, and at least one wager input device for receiving wagers from players for playing the wagering game(s). The gaming system also includes a cabinet with a universal mounting base integrated to the top of the cabinet. The universal mounting base is designed to interchangeably support a selected one of a plurality of different top-box mounted fixtures. At least one electrical connector is accessible from the exterior of the cabinet. The electrical connector is configured to electrically connect the selected top-box mounted fixture(s) to the cabinet.

According to yet another aspect of the disclosure, a method is presented for operatively attaching a selected one of a plurality of different top-box mounted fixtures on top of a wagering game terminal. The method of this embodiment comprises: coupling, via at least one electrical connector accessible from the exterior of a cabinet of the wagering game terminal, all electrical connections between the selected top-box mounted fixture(s) and the wagering game terminal; and mounting the selected fixture(s) to the cabinet via a universal mounting interface capable of interchangeably supporting any of the different top-box mounted fixtures.

In accordance with even yet another aspect of the present disclosure, a method of changing the appearance of a wagering game machine is presented. The method of this embodiment comprises: detaching a first of a plurality of different top-box mounted fixtures from the cabinet of the wagering game machine; disconnecting all electrical connections between the wagering game machine and the first top-box mounted fixture without opening the cabinet of the wagering game machine; connecting electrical connections between the wagering game machine and a second of the plurality of different top-box mounted fixtures without opening the cabinet of the wagering game machine; and attaching the second top-box mounted fixture to the cabinet of the wagering game machine.

The above summary is not intended to represent each embodiment, or every aspect, of the present disclosure. The above features and advantages, and other features and advantages of the present disclosure, will be readily apparent from the following detailed description of the preferred embodiments and best modes for carrying out the present invention when taken in connection with the accompanying drawings and appended claims.

Figure 1A:
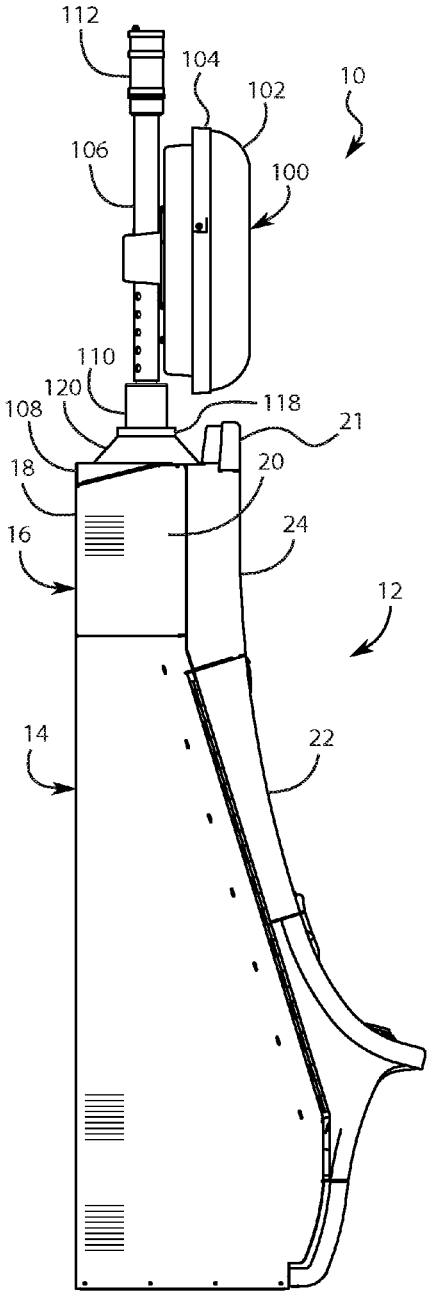
FIG. 1A is a side-view illustration of an exemplary gaming machine in accordance with embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, this disclosure is to cover all modifications, equivalents, and alternatives falling within the spirit and scope of the invention as defined by the appended claims.

DETAILED DESCRIPTION OF THE EXEMPLARY EMBODIMENTS

While this disclosure is susceptible of embodiment in many different forms, there are shown in the drawings and will herein be described in detail representative embodiments with the understanding that the present disclosure is to be considered as an exemplification of the principles of the invention and is not intended to limit the broad aspect of the invention to the embodiments illustrated. To that extent, elements and limitations that are disclosed, for example, in the Abstract, Summary, and Detailed Description of the Exemplary Embodiments sections, but not explicitly set forth in the claims, should not be incorporated into the claims, singly or collectively, by implication, inference or otherwise.

Figure 1B:
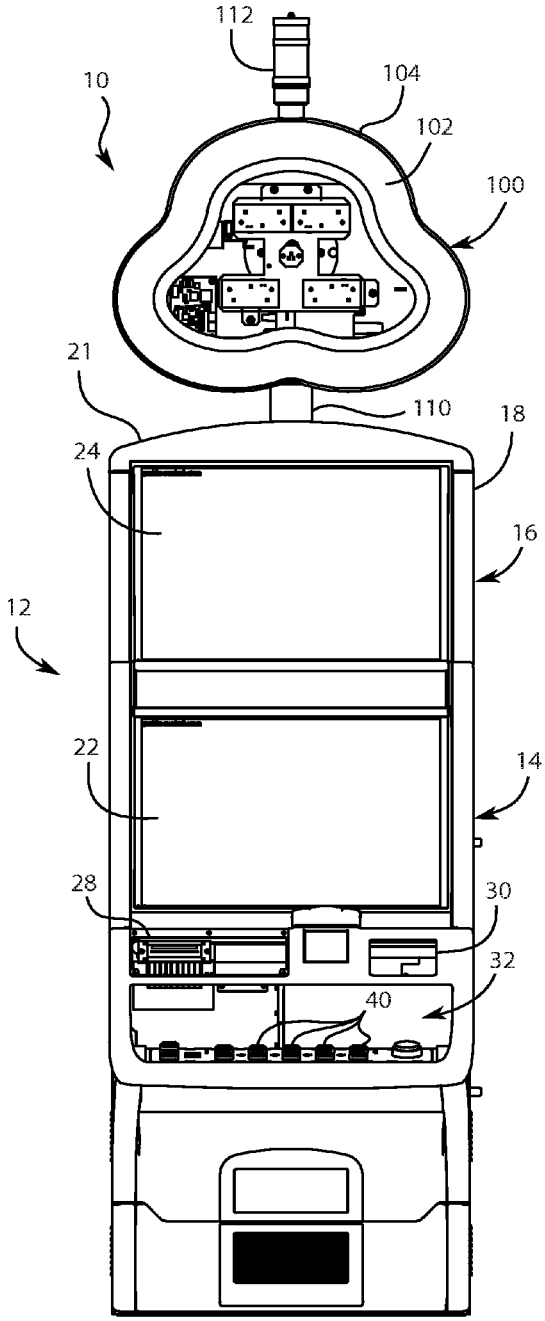
FIG. 1B is a front-view illustration of the gaming machine of FIG. 1A.

Referring to FIGS. 1A and 1B, a perspective-view illustration of an exemplary gaming terminal 10 (also referred to herein as "wagering game machine" or "gaming machine") is shown in accordance with embodiments of the present disclosure. The gaming terminal 10 of FIGS. 1A and 1B may be used, for example, in traditional gaming establishments, such as casinos and cruise ships, and non-traditional gaming establishments, such as pools, hotels, restaurants, and airports. The gaming terminal 10 may be any type of gaming terminal and may have varying structures and methods of operation. For instance, the gaming terminal 10 may be an electromechanical gaming terminal configured, for example, to play mechanical slots, or it may be an electronic gaming terminal configured, for example, to play a video casino game, such as slots, keno, poker, blackjack, roulette, craps, etc. It should be understood that although the gaming terminal 10 is shown as a free-standing gaming terminal of the upright type, the gaming machines of the present disclosure may take on a wide variety of other forms, such as free-standing gaming terminals of the slant-top type, "countertop" gaming devices, etc. Finally, the drawings presented herein are not to scale and are provided purely for instructional purposes; as such, the individual and relative dimensions shown in the drawings are not to be considered limiting.

The gaming terminal 10 comprises a cabinet, designated generally as 12, which, in the embodiment shown, is defined by a base cabinet 14 with a top box 16 that is mounted directly on top of the base cabinet 12. In some embodiments, the top box 16 includes an internal substructure (not visible in the views provided herein) that is fitted with an outer shell 18 and front display glass 18 (FIG. 1B) that covers a secondary display area 24, described below. The outer shell 18 can be made of a variety of materials, and contain features and information relevant to the play of the game or to attract players to the game. For example, the side shell 18 of the top box 16 may contain a side-facing artwork panel 20 (FIG. 1A), which may optionally be backlit from within the top box 16. This artwork panel may contain the name of the game or other artwork such as advertisements. The position of the top box side display artwork allows casino patrons moving past a row of gaming machines to view information placed on the game without having to stand directly in front of a machine. A crown 21 extends transversely along the forward-most upper edge of the top box 14, partially concealing the structural features of the gaming machine 10 on the uppermost surface thereof.

Figure 2:
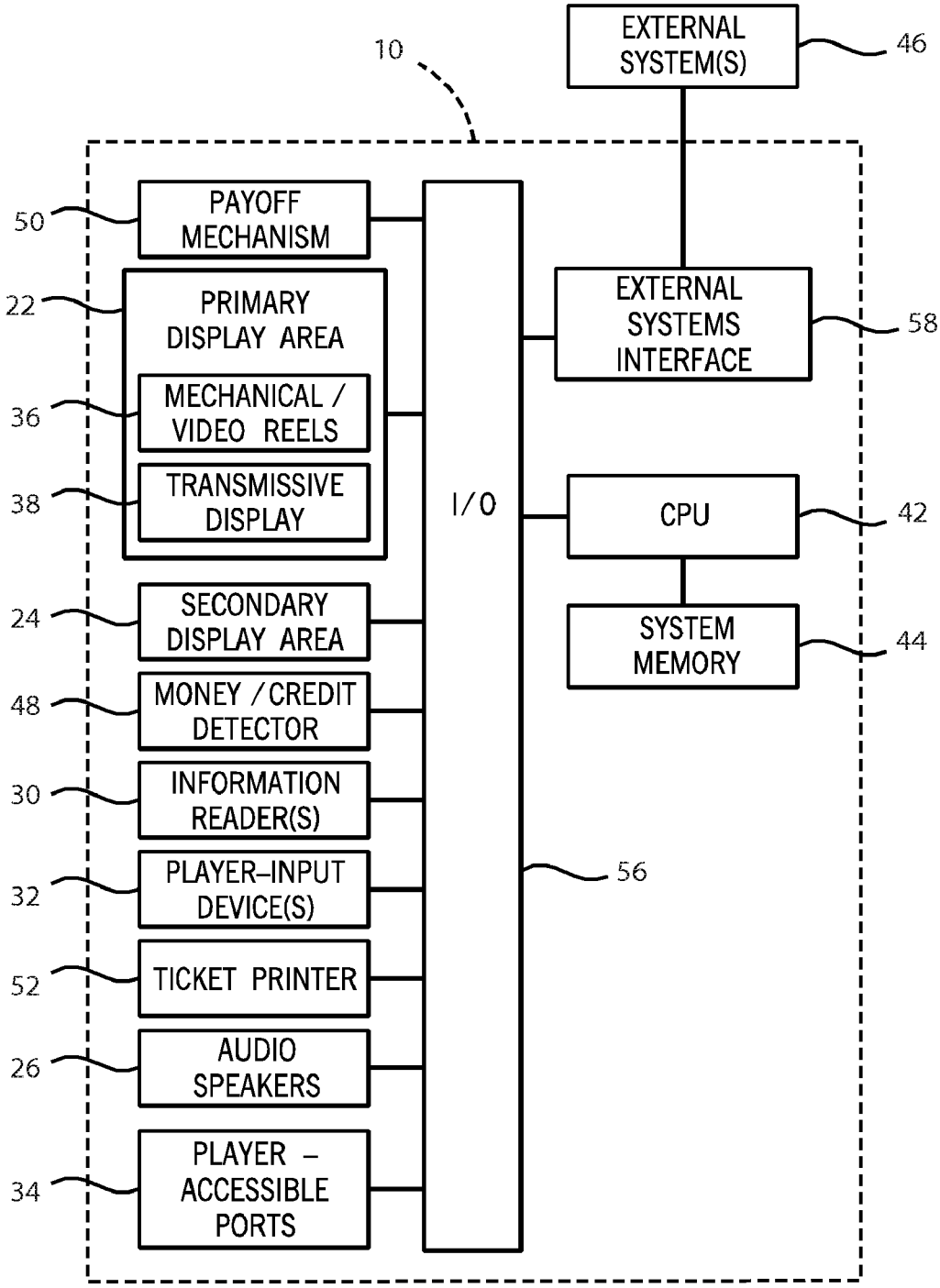
FIG. 2 is a schematic diagram of an exemplary gaming system in accordance with embodiments of the present disclosure.

For output devices, the gaming terminal 10 may include a primary display area 22, a secondary display area 24, and one or more audio speakers (illustrated schematically at 26 in FIG. 2). The primary display area 22 and/or secondary display area 24 may display information associated with wagering games, non-wagering games, community games, progressives, advertisements, services, premium entertainment, text messaging, emails, alerts or announcements, broadcast information, subscription information, etc. For input devices, the gaming terminal 10 may include, as seen in FIG. 1B, one or more information readers 28, a coin acceptor (not shown), a bill validator 30, one or more player-input devices 32, and one or more player-accessible ports 34 (e.g., an audio output jack for headphones, a video headset jack, a wireless transmitter/receiver, etc., shown in FIG. 2). While these typical components found in the gaming terminal 10 are described below, it should be understood that numerous additional/alternative peripheral devices and other elements may exist and may be used in any number of combinations to create various forms of a gaming terminal.

The primary display area 22 may include a mechanical-reel display, a video display, or a combination thereof in which a transmissive video display in front of the mechanical-reel display portrays a video image superimposed over the mechanical-reel display. Further information concerning the latter construction is disclosed in commonly owned U.S. Pat. No. 6,517,433, to Loose et al., entitled "Reel Spinning Slot Machine with Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10.

Figure 3:
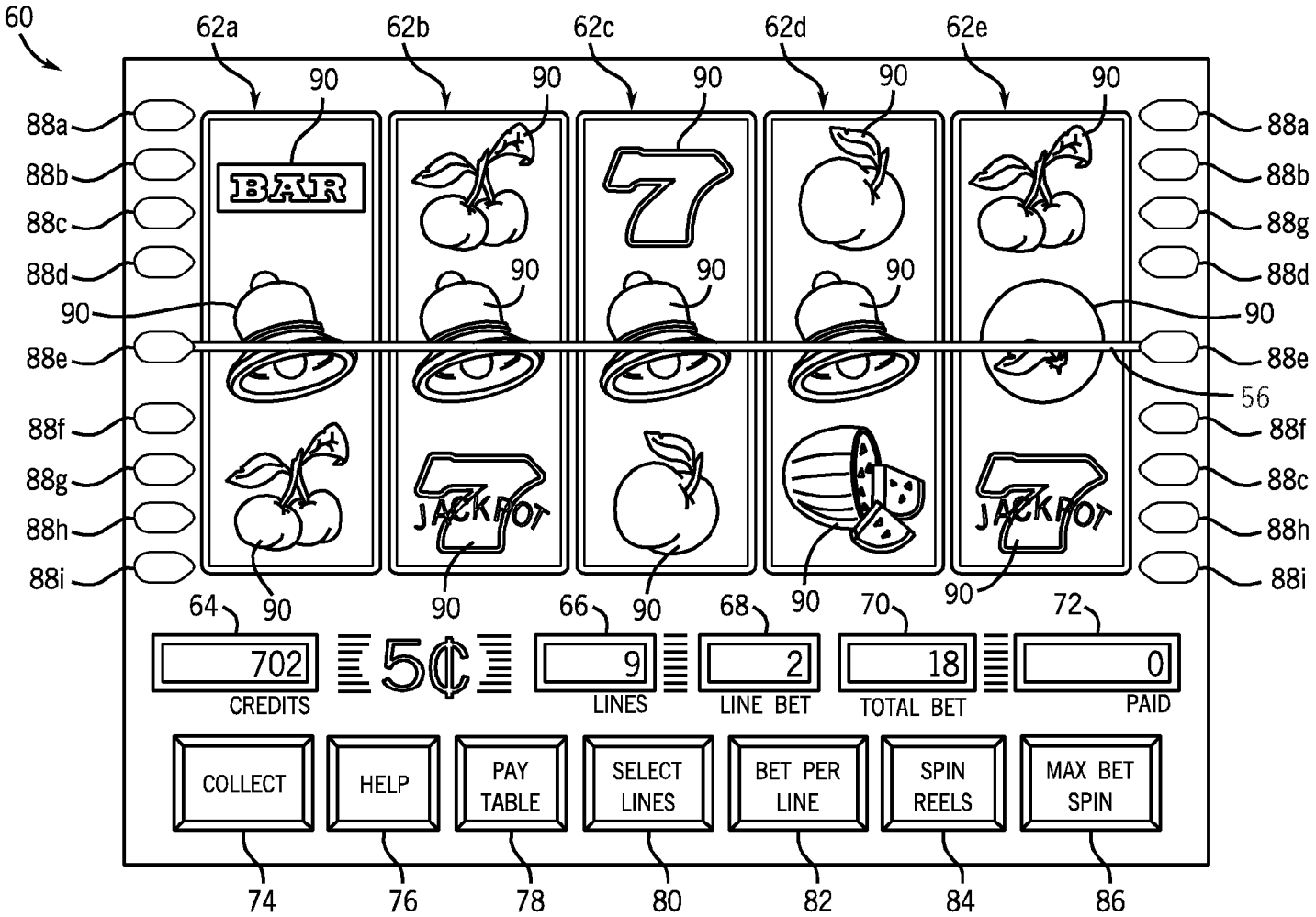
FIG. 3 is a screen shot of a basic-game screen from an exemplary wagering game that may be played, for example, on the gaming machine of FIGS. 1A and 1B and/or the gaming system of FIG. 2.

As seen, for example, in FIG. 3, the primary display area 22 may include one or more paylines 56 extending along a portion thereof. In some embodiments, the primary display area 22 comprises a plurality of mechanical reels 36 (FIG. 2) and a transmissive video display 38 (or a reflected image arrangement in other embodiments) in front of the mechanical reels 36. If the wagering game conducted via the gaming terminal 10 relies upon the video display only, and not mechanical reels, the mechanical reels may be removed from the interior of the terminal 10 and the video display 38 may be of a non-transmissive type (featured below in a representative embodiment in FIG. 3). In contrast, if the wagering game conducted via the gaming terminal 10 relies upon the mechanical reels 36 but not the video display 38, the video display 38 may be replaced with a conventional glass panel. Further, the underlying mechanical-reel display may be replaced with a video display such that the primary display area 22 includes layered video displays, or may be replaced with another mechanical or physical member such as a mechanical wheel (e.g., a roulette game), dice, a pachinko board, or a diorama presenting a three-dimensional model of a game environment.

Video images in the primary display area 22 and/or the secondary display area 24 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 32 may include, for example, a plurality of buttons 40 on a button panel. In addition, or as an alternative thereto, a touch screen may be mounted over the primary display area 22 and/or the secondary display area 24 and having one or more soft touch keys, as exemplified in FIG. 3. The player-input devices 32 may further comprise technologies that do not rely upon touching the gaming terminal, such as speech-recognition technology, movement- and gesture-sensing technology, eye-tracking technology, etc.

The information reader 28 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 28 for accessing an account associated with cashless gaming, player tracking, game customization, saved-game state, data transfer, and casino services as more fully disclosed, for example, in U.S. Patent Application Publication No. 2003/0045354, entitled "Portable Data Unit for Communicating with Gaming Machine Over Wireless Link," which is incorporated herein by reference in its entirety. The account may be stored directly on the portable medium, or at an external system 46 (see FIG. 2) as more fully disclosed, for example, in U.S. Pat. No. 6,280,328, to Holch et al., entitled "Cashless Computerized Video Game System and Method," which is incorporated herein by referenced in its entirety. To enhance security, the individual carrying the portable medium may be required to enter a secondary independent authenticator (e.g., password, PIN number, biometric, etc.) to access their account.

FIGS. 1A and 1B show an example of a signage display in the form of a marquee 100 for a gaming machine. In this embodiment, the marquee 100 is comprised of artwork area 102 (FIG. 1B) supported within a frame 104. The artwork 102 can be backlit, front-lit or edge-lit by any lighting method including incandescent, fluorescent, LEDs, neon, and cold cathode fluorescent lamp (CCFL). The artwork 102 may in fact not be illuminated. The marquee 100 is movably mounted to a support post 106. The support post 106 is mounted to a bracket 108 via a universal mounting base 120. The bracket 108 is affixed to the top box 16 of the gaming machine 10, behind the crown 21. A tower light 112 is attached to the distal end of the support post 106.

The marquee 100 in FIGS. 1A and 1B has a rounded "cloud" shape. The cloud shaped marquee 100 may include a mounting arrangement and pivot mechanisms that allow the marquee 100 to be securely attached to the post 106 and rotated (e.g., manually or automated) when needed. Additional information regarding the marquee assembly depicted in FIGS. 1A and 1B can be found in commonly assigned U.S. Patent Application Publication No. 2006/0277805 A1, entitled "Gaming Machine with Common Alterable Signage Display," to Thomas Kopera et al., which was filed on Jun. 7, 2006, and is incorporated herein by reference in its entirety.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device(s). The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and/or multiple program memories. The money/credit detector 48 signals the processor 42 that money and/or credits have been input via a value-input device, such as the information reader 28 or bill validator 30 of FIG. 1, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 32) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 22, the secondary display area 24, the player-input device 26, and a payoff mechanism 50. The payoff mechanism 50 is operable, for example, in response to instructions from the controller 42 to award a payoff to the player in response to certain winning outcomes that might occur in the base game, the bonus game(s), or via an external game or event. The payoff may be provided in the form of money, redeemable points, services or any combination thereof. Such payoff may be associated with a ticket (from a ticket printer 52, FIG. 2), portable data unit (e.g., a card), coins, currency bills, accounts, and the like. The payoff amounts distributed by the payoff mechanism 50 are determined by one or more pay tables stored in the system memory 44.

In some embodiments, the controller 42 is also connected to, and controls, the marquee 100 and tower light 112. For example, the controller 42 can regulate the illumination of the marquee 100 and tower light 112. To that regard, the controller 42 can effectuate a light show by changing the color scheme of the marquee 100 and tower light 112. Moreover, the controller 42 can control any automation associated with the marquee 100.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 may be connected to an external system interface 58, which is connected to the external system 46. In this exemplary configuration, the controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

The controller 42 of FIG. 2 comprises any combination of hardware, software, and/or firmware now known or hereinafter developed that may be disposed or reside inside and/or outside of the gaming terminal 10, and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Security features may be advantageously utilized where the gaming machine 10 communicate wirelessly with external systems 46, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine, etc.), access points (AP) (e.g., a network device or devices that allow(s) an STA to communicate wirelessly and to connect to a(nother) network, such as a communication device associated with I/O circuit(s) 56), and authentication servers (AS) (e.g., an external system 46), which provide authentication services to STAs. Information regarding security features for wireless networks may be found, for example, in the National Institute of Standards and Technology (NIST), Technology Administration U.S. Department of Commerce, Special Publication (SP) 800-97, ESTABLISHING WIRELESS ROBUST SECURITY NETWORKS: A GUIDE TO IEEE 802.11, and SP 800-48, WIRELESS NETWORK SECURITY: 802.11, BLUETOOTH AND HANDHELD DEVICES, both of which are incorporated herein by reference in their entireties.

Referring now to FIG. 3, an image of a basic-game screen 60 adapted to be displayed on the primary display area 22 of FIG. 1 is illustrated, according to one embodiment of the present disclosure. A player begins play of a basic wagering game by providing a wager (e.g., inserting a cash note or substitute currency media into the validator 30, and/or inserting a player-card into information reader 28). A player can operate or interact with the wagering game using the one or more player-input devices 32. The controller 42, the external system 46, or both, in alternative embodiments, operate(s) to execute a wagering game program causing the primary display area 22 to display the wagering game that includes a plurality of visual elements.

The basic-game screen 60 may be displayed on the primary display area 22 or a portion thereof. In FIG. 3, the basic-game screen 60 portrays a plurality of simulated movable reels 62*a-e*. Alternatively or additionally, the basic-game screen 60 may portray a plurality of mechanical reels, as described hereinabove. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

One or more paylines 56 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation, animation, or other indicia, and may further include a "blank" symbol.

Symbol combinations may be evaluated as line pays or "scatter pays." Line pays may be evaluated left to right, right to left, top to bottom, bottom to top, diagonally, or any combination thereof by evaluating the number, type, or order of symbols 90 appearing along an activated payline 56 (FIG. 3). Scatter pays, on the other hand, are evaluated without regard to position or paylines, and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown, a gaming terminal with any plurality of reels may also be used in accordance with the present disclosure.

Figure 4:
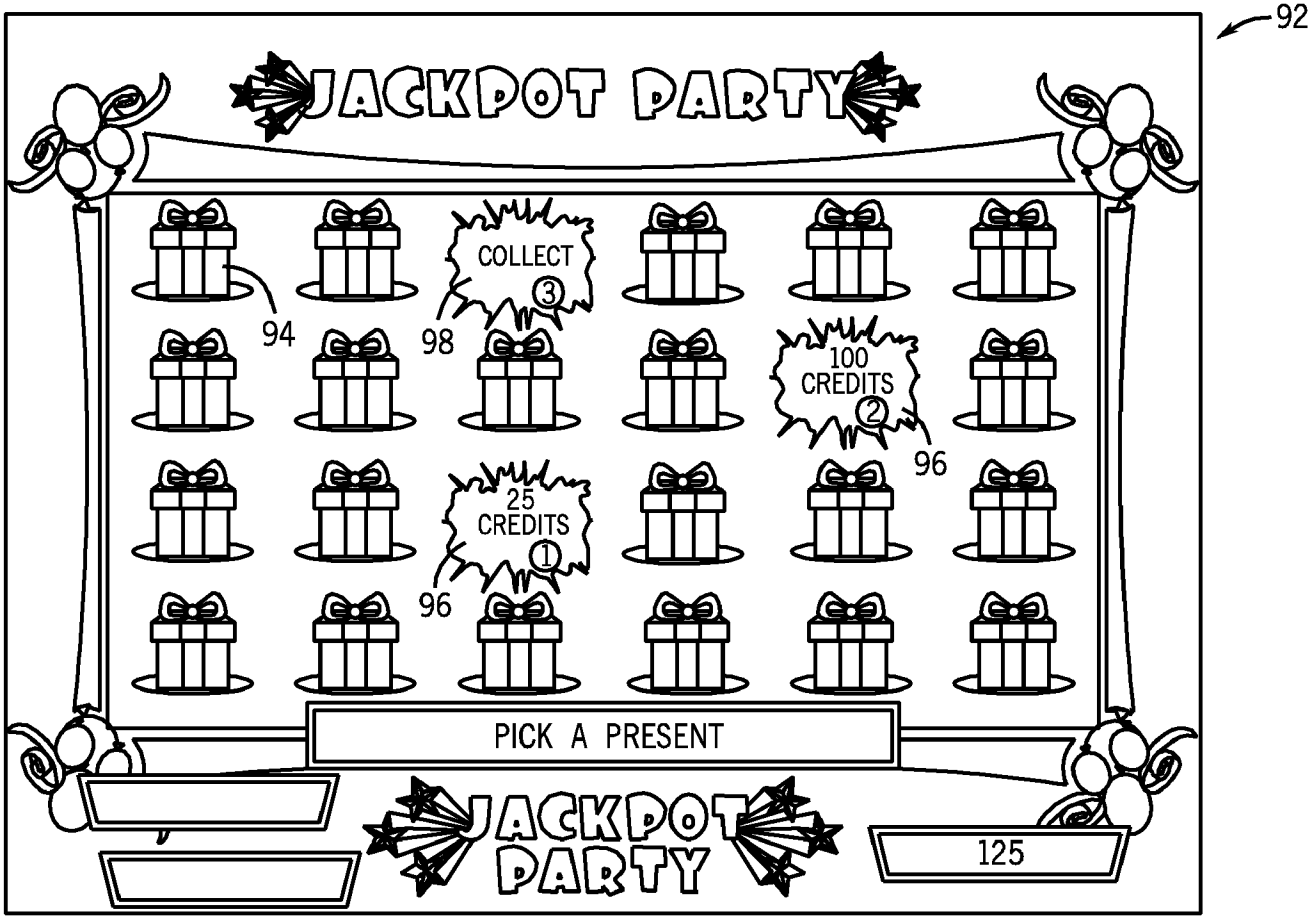
FIG. 4 is a screen shot of a bonus-game screen from an exemplary wagering game that may be played, for example, on the gaming machine of FIGS. 1A and 1B and/or the gaming system of FIG. 2.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
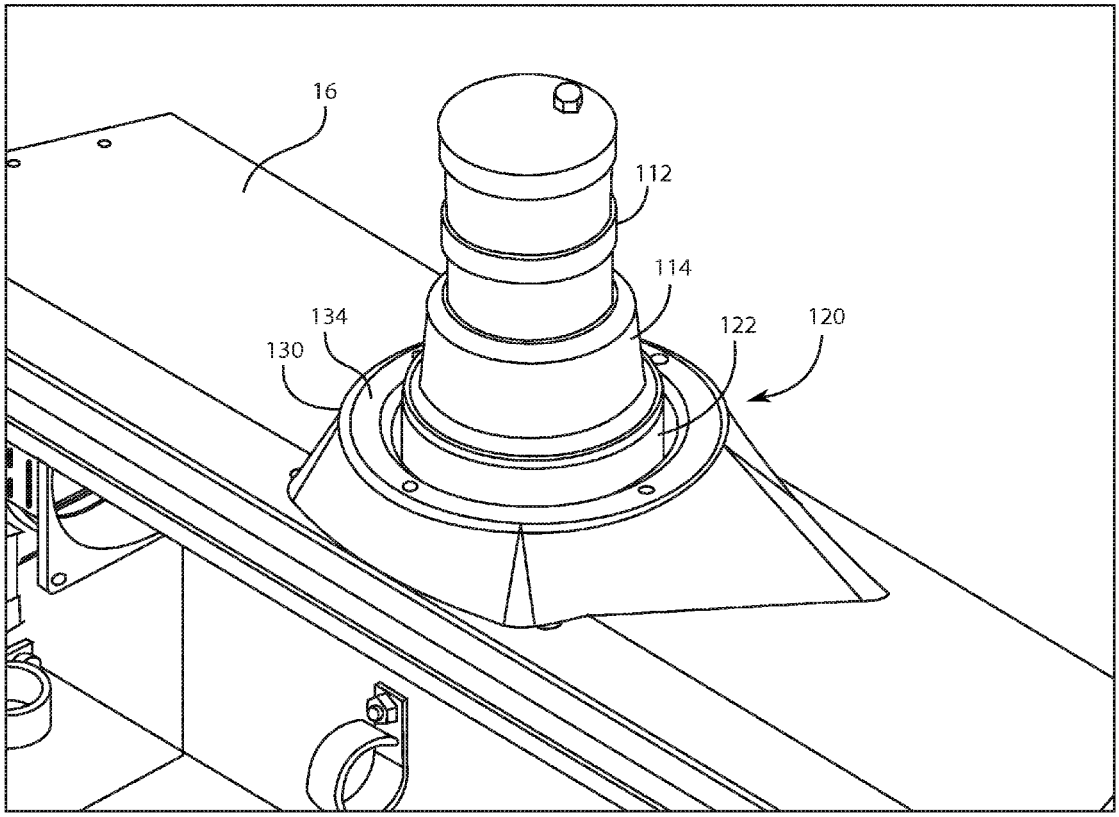
FIG. 5 is a perspective-view illustration of an exemplary universal mounting base with a tower light in accordance with embodiments of the present disclosure.
Figure 6:
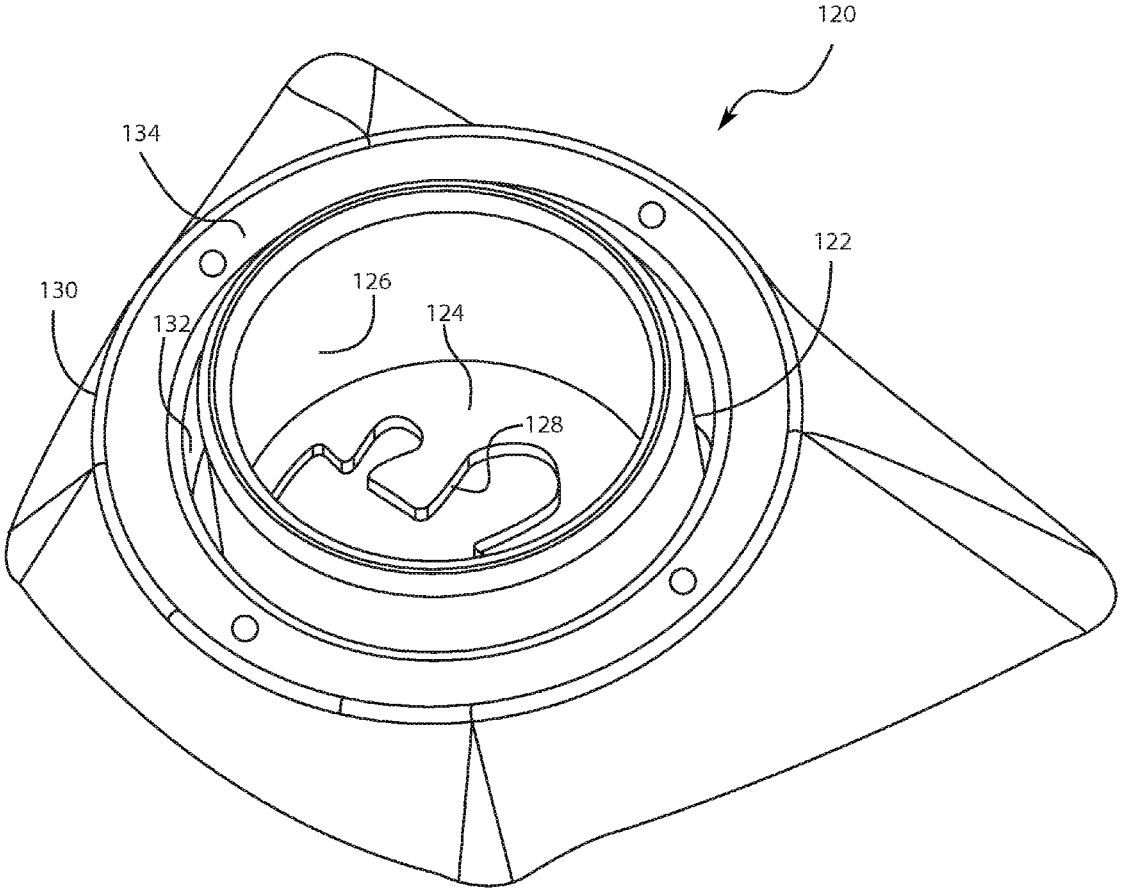
FIG. 6 is a perspective-view illustration of the exemplary universal mounting base of FIG. 5 with the tower light removed.

Referring now to FIGS. 5 and 6, a perspective-view illustration of an exemplary universal mounting base, designated generally as 120, for the gaming terminal 10 of FIGS. 1A and 1B, is presented in accordance with one embodiment of the present disclosure. The mounting base 120 is intended to be integrated to the top of the gaming machine cabinet 12. According to one exemplary configuration, the base 120 is fabricated, for example, from a polymeric material and integrally formed with the top panel of the outer shell 18 of the top box 16. In an alternate arrangement, the base 120 is mechanically fastened to the top of the top box 16, for example, via one or more bolts (not shown in FIG. 5).

The universal mounting base 120 is designed to support any one of a plurality of different top-box mounted fixtures, such as tower lights, marquees, and other signage displays. In FIG. 5, for example, the mounting base 120 has an inner support ring 122 configured to receive and retain a tower light 112. Specifically, the inner diameter of the inner support ring 122 is complementary with the outer diameter of the tower light's lamp coupling nozzle 114 such that the tower light 112 operatively aligns with and seats partially within the inner support ring 122. As seen in FIG. 6, the inner support ring 122 has a cup-like configuration with a recessed substrate 124 at the bottom of an annular wall 126. The substrate 124 has a cutout portion 128 that allows the electrical interface on the bottom of the lamp coupling nozzle 114 to pass through the substrate 124 of the universal mounting base 120, and electrically couple with a matching electrical connector, such as a blind mate connector. Alternatively, a pigtail connector (not shown in FIG. 6, but described below with respect to FIGS. 9A and 9B) can extend up through the cutout portion 128. Regardless of type, the electrical connector is accessible from the exterior of the cabinet 12, such that the top-box mounted fixture (e.g., tower light 112) can be electrically connected to the gaming terminal 10 without having to open either the base cabinet 14 or the top box 16. The tower light 112 may then be secured within the mounting base 120 via a clamp, pawl, bolt, or other means.

The mounting base 120 of FIGS. 5 and 6 also includes an outer support ring 130 that is concentrically aligned with the inner support ring 122 to define an annular slot 132 therebetween. An elongated sleeve 110 at the distal end of the marquee mounting post 106 is telescopically received within the annular slot 132 to thereby attach the marquee display 100 to the top box 16, as shown in FIG. 1A. The mounting post 106 of the marquee display 100 has an outwardly projecting annular flange 118 (FIG. 1A) that seats on top of an upper support surface 134 (FIG. 6) of the outer support ring 130, and is mechanically attached thereto, for example, via security screws. The shape and size of the inner and outer support rings 122, 130 can be modified to accommodate lighting fixtures and marquee displays of varying dimensions. However, in some preferred embodiments, the universal mounting base 120 has a standardized configuration (i.e., uniform shape and dimensions) adapted to accommodate any of an array of different light fixtures and displays.

Figure 7:
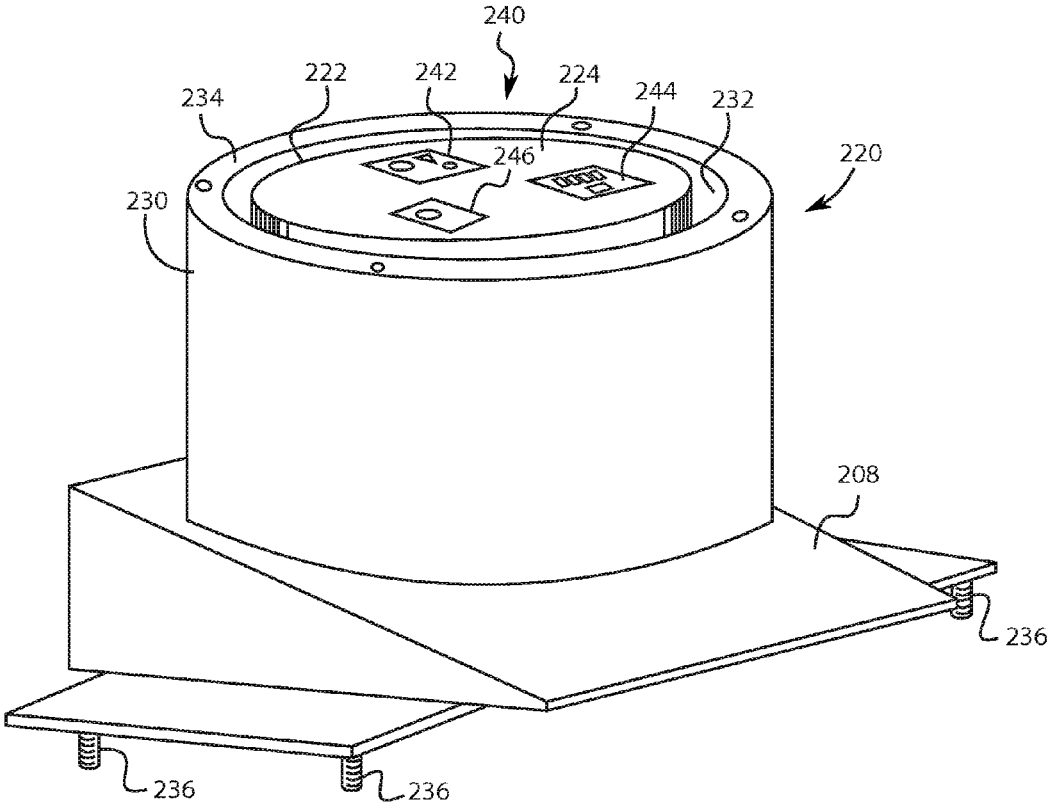
FIG. 7 is a perspective-view illustration of an exemplary universal mounting base in accordance with embodiments of the present disclosure.

FIG. 7 is a perspective-view illustration of an exemplary universal mounting base 220 in accordance with another embodiment of the present disclosure. Similar to the mounting base 120 described above with respect to FIGS. 5 and 6, the mounting base 220 of FIG. 7 is intended to be affixed to the top box of a gaming machine, such as gaming terminal 10 of FIG. 1A. In contrast to FIGS. 5 and 6, the mounting base 220 of this embodiment comprises a cylindrical outer support ring 230 that is concentrically aligned with an inner support column 222, both of which are buttressed on a bracket 208. Extending vertically downward from a bottom surface of the bracket 208 are four threaded posts 236 (three of which are visible in the view provided), each of which is received in a complementary aperture in the top of the machine cabinet—e.g., the crown panel of the top box outer shell 18 of FIG. 1A. Once properly received in a respective aperture, a nut is passed over the distal end of each post 236 to rigidly attach the bracket 208 to the cabinet 12.

The universal mounting base 220 is designed to support any one of a plurality of different top-box mounted light fixtures, marquees, and displays. In the embodiment shown in FIG. 7, an annular slot 232 is defined between the concentrically aligned inner support column 222 and outer support ring 230. The elongated sleeve 110 of the marquee mounting post 106 (illustrated, for example, in FIG. 1A) may be telescopically received within the annular slot 232 to thereby attach the marquee display 100 to the top box 16. The annular flange 118 (FIG. 1A) of the mounting post 106 seats on top of an upper support surface 234 (FIG. 7) of the outer support ring 230, and is rigidly attached thereto, for example, via security screws. Likewise, the lamp coupling nozzle 114 of the tower light 112 would be fabricated with a similar sleeve-like configuration as the elongated sleeve 110 of the marquee mounting post 106 such that the tower light 112 is telescopically received by, attached to, and supported on the universal mounting base 220 in a similar fashion as the marquee 100.

In contrast to FIGS. 5 and 6, a blind mate connector arrangement, designated generally as 240 in FIG. 7, is integrated into an upper support surface 224 of the inner support column 222, which is generally coplanar with the upper support surface 234 of the outer support ring 230. In the embodiment shown, the blind mate connector arrangement 240 includes three blind mate terminals 242, 244 and 246, respectively, each of which connects with an external mating connector (not shown in FIG. 7) on the selected top-box mounted light fixture being supported by the base 220. Each terminal 242, 244, 246 may comprise a shield and a dielectric housing with a plurality of electrical ports received within the housing. Other blind mate electrical connector arrangements are also envisioned as being within the scope of the present disclosure. The blind mate connector arrangement 240 of FIG. 7 is accessible from the exterior of the gaming terminal cabinet 12, such that the top-box mounted fixture (e.g., marquee 100 or tower light 112) can be electrically coupled to the gaming terminal 10 without having to open either the base cabinet 14 or the top box 16, and without having to run electrical cabling from the top-box mounted fixture down through the crown of the top box 16.

Figure 8A:
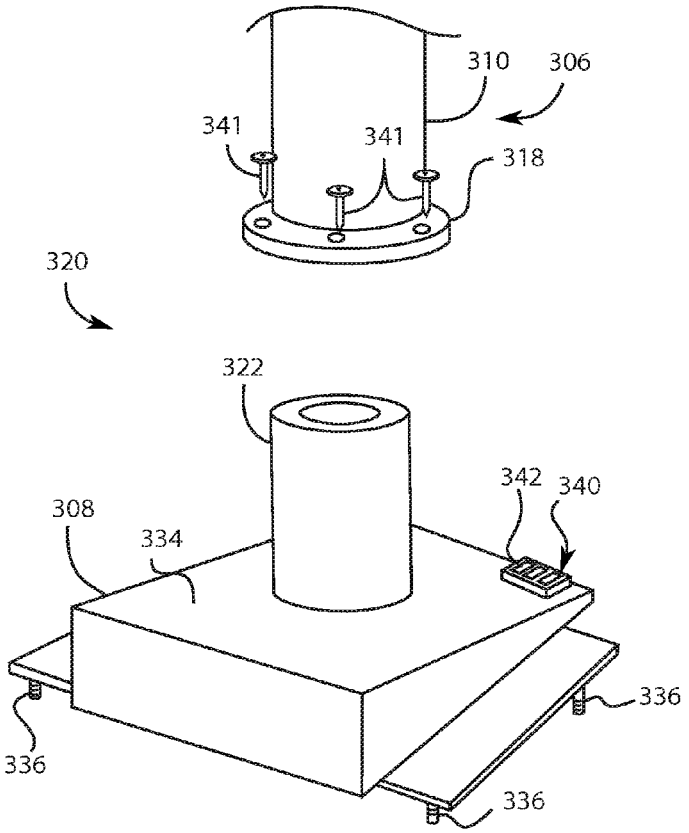
FIG. 8A is a perspective-view illustration of an exemplary universal mounting base in accordance with embodiments of the present disclosure.
Figure 8B:
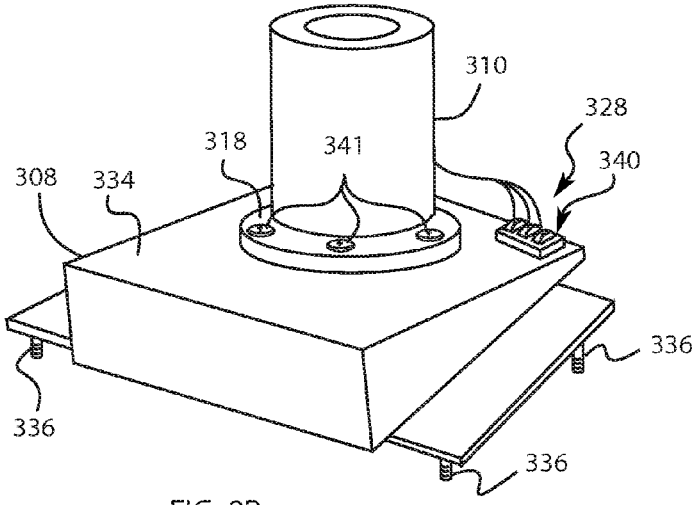
FIG. 8B is a perspective-view illustration of the universal mounting base of FIG. 8A with the top-box mounted marquee/light fixture attached thereto.

FIGS. 8A and 8B illustrate an exemplary universal mounting base 320 in accordance with yet another embodiment of the present disclosure. Similar to the mounting base arrangements described above with respect to FIGS. 5-7, the mounting base 320 of FIGS. 8A and 8B is intended to be affixed to the top box of a gaming machine, such as gaming terminal 10 of FIG. 1A. In this embodiment, however, the mounting base 320 comprises a single, elongated tubular support column 322 that is buttressed on a bracket 308. Extending vertically downward from a bottom surface of the bracket 308 are four threaded posts 336 (three of which are visible in the view provided), each of which is received in a complementary aperture in the top panel of the top box outer shell (e.g., 18 of FIG. 1A). Once properly received in a respective aperture, a nut is passed over the distal end of each post 336 and tightened down to rigidly attach the bracket 308, and thus the entire mounting base 320, to the cabinet 12.

The universal mounting base 320 is designed to support any one of a plurality of different top-box mounted light fixtures, marquees, and displays. In the embodiment shown in FIG. 8A, the tubular support column 322 of the mounting base 320 is telescopically received inside the hollow center of a sleeve end 310 of a marquee mounting post 306. As seen in FIG. 8B, an annular flange 318, which extends around a lower circumferential edge of the mounting post sleeve end 310, seats on top of an upper support surface 334 (FIG. 7) of the support bracket 308, and is mechanically attached thereto, for example, via security screws 341. Likewise, the lamp coupling nozzle 114 of the tower light 112 (FIG. 1) would be fabricated with a similar sleeve-like configuration as the sleeve end 310 of the marquee mounting post 106 such that the support column 322 is at least partially telescopically received within the lamp coupling nozzle 114. In so doing, the tower light 112 is attached to and supported on the universal mounting base 220 in a similar fashion as the marquee 100.

A multi-point terminal block, identified by reference numeral 340 in FIGS. 8A and 8B, is integrated into the upper support surface 324 of the bracket 308. In the embodiment shown, the multi-point terminal block 340 includes a plurality of electrical terminals 342 (FIG. 8A), each of which connects with a respective external mating connector 328 (FIG. 8B) projecting from the selected top-box mounted light fixture being supported by the universal mounting base 320. As seen in both FIGS. 8A and 8B, the multi-point terminal block 340 is readily accessible from the exterior of the gaming terminal cabinet 12, such that the top-box mounted fixture (e.g., marquee 100 or tower light 112) can be electrically coupled to the gaming terminal 10 without having to open either the base cabinet 14 or the top box 16. Unlike FIGS. 5-7, where the top-box mounted fixture is electrically connected and physical mounted in the same action, the configuration illustrated in FIGS. 8A and 8B requires the electrical connections be completed separately from the physical mounting of the top-box mounted fixture to the cabinet.

Figure 9A:
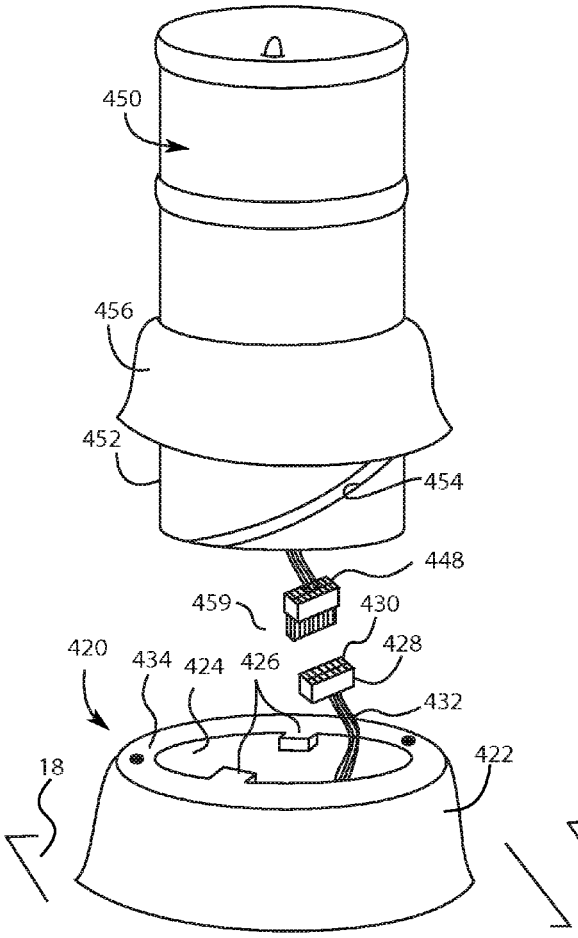
FIG. 9A is a perspective-view illustration of an exemplary universal mounting base in accordance with embodiments of the present disclosure.
Figure 9B:
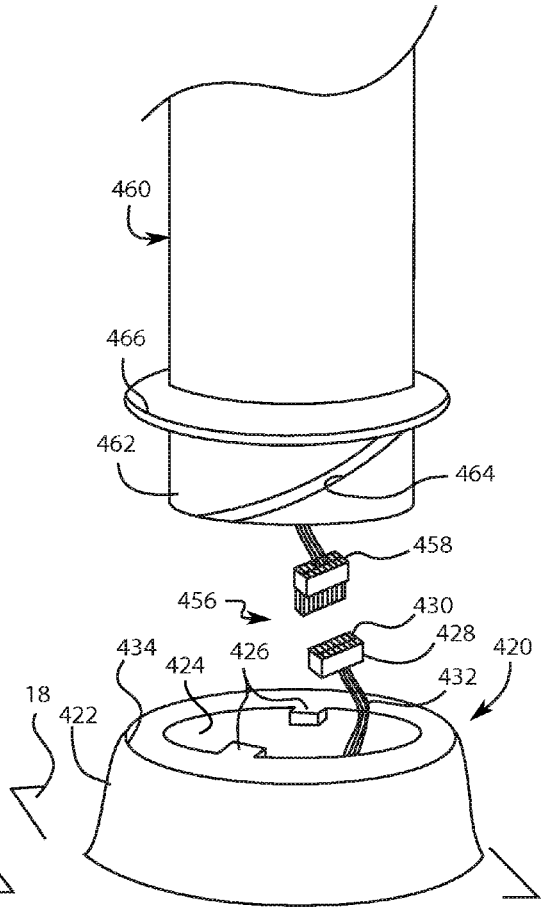
FIG. 9B is an alternate view of the universal mounting base of FIG. 9A.

Turning next to FIGS. 9A and 9B, a universal mounting base 420 is illustrated in accordance with another embodiment of the present disclosure. Similar to the various universal mounting base configurations described above with respect to FIGS. 5 through 8B, the mounting base 420 of FIGS. 9A and 9B is intended to be affixed on top of the top box of a gaming machine, such as gaming terminal 10 of FIG. 1A. In this embodiment, however, the mounting base 420 does not utilize a bracket for attaching to the gaming machine cabinet 10; the mounting base 420 comprises an annular twist-lock platform 422 that is mounted directly to the gaming cabinet 12, namely to the crown panel of the outer shell 18 of the top box 16.

The universal mounting base 420 is designed to support a selected one of a plurality of different top-box mounted light fixtures, marquees, and displays. In the embodiment of FIGS. 9A and 9B, the annular twist-lock platform 422 includes a central cavity 424 with a pair of key teeth 426 that project radially inwardly from an inner peripheral edge of the cavity 424. The distal end of the lamp coupling nozzle 452 of a tower light 450 includes two helical channels 454 (only one of which is visible in FIG. 9A), each of which receives a respective one of the key teeth 426. By way of non-limiting example, once the key teeth 426 are properly aligned with the helical channels 454, the lamp coupling nozzle 452 is fed vertically downward into the platform cavity 424, and rotated (clockwise in the view provided) until the lamp coupling nozzle 452 locks to the base 422. A bottom surface of a toroidal skirt 456, which protrudes radially outward from the bottom end 452 of the tower light 450, seats on top of an upper support surface 434 of the twist-lock platform 422.

In a similar regard, the distal end 462 of a marquee support post 460 includes two helical channels 454 (only one of which is visible in FIG. 9B), each of which receives a respective one of the twist-lock platform key teeth 246. By way of non-limiting example, once the key teeth 426 are properly aligned with the helical channels 464, the marquee support post 460 is fed vertically downward into the platform cavity 424, and rotated (clockwise in the view provided) until the bottom end 452 locks to the platform 422. A bottom surface of an annular flange 466, which protrudes radially outward from the tower light 450, seats on top of an upper support surface 434 of the twist-lock platform 422.

A pigtail connector 428 extends up through the central cavity 424 of the annular twist-lock platform 422. In the embodiment shown, the pigtail connector 428 consists of a multi-socket electrical connector head 430 at the distal end of two flexible electrical cables 432. Each of the sockets in the connector head 430 is adapted to receive a cooperating pin conductor 459 on a mating connector 458, one of which is attached to the tower light 450 and one of which is attached to the marquee support post 460. As seen in both FIGS. 9A and 9B, the pigtail connector 428 is accessible from the exterior of the gaming terminal cabinet 12, such that the top-box mounted fixture (e.g., the tower light 450 or the marquee post 460) can be electrically coupled to the gaming terminal 10 without having to open either the base cabinet 14 or the top box 16. The pigtail connector 428 consists essentially of a single electrical connection point configured to electrically couple with any of the plurality of different light fixtures and displays.

Also presented herein is an improved method of operatively attaching one of a plurality of different top-box mounted fixtures to the top of a wagering game terminal. The method is described herein with respect to the structure illustrated in FIGS. 9A and 9B; however, this method may be practiced on any of the various universal mounting base configurations disclosed herein. The method comprises providing the wagering game terminal with a cabinet having a universal mounting interface, such as the universal mounting base 420, and at least one electrical connector, such as the pigtail connector 428, that is accessible from the exterior of the cabinet. The method then includes coupling, via the at least one electrical connector 428, all electrical connections between the selected top-box mounted fixture and the wagering game terminal. Subsequent thereto or contemporaneous therewith, the selected fixture is then mounted to the cabinet 12 via the universal mounting interface, as described hereinabove. It is desirable, in some embodiments, that the selected fixture be electrically coupled to the wagering game machine without opening the cabinet 12 of the wagering game machine 10.

Figure 10:
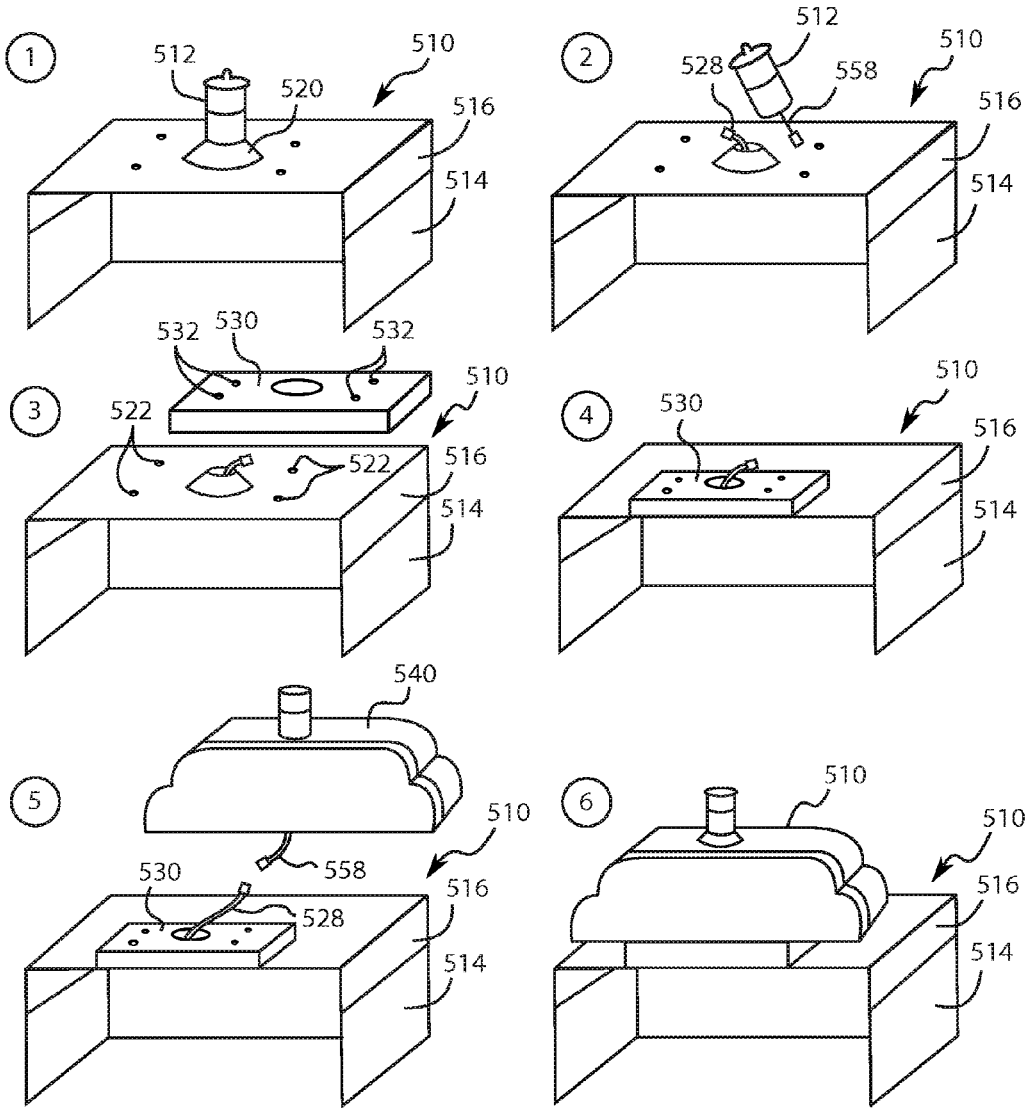
FIG. 10 illustrates a method of changing the appearance of a gaming machine in accordance with embodiments of the present disclosure.

With reference now to FIG. 10, a method of changing the appearance of a wagering game machine 510 is featured. The wagering game machine 510 of FIG. 10, similar to the gaming terminal 10 of FIGS. 1A and 1B, has a cabinet with a top box 516 that is vertically adjacent a base cabinet 514. The method of changing the appearance of the wagering game machine 510 includes, in step 1, detaching a first of a plurality of different top-box mounted light fixtures and displays from the cabinet top box 516 of the wagering game machine 510. In the illustrated embodiment, a tower light 512 is attached to the universal mounting base 520. The tower light 512 is mechanically unfastened from the universal mounting base—e.g., via removing any bolts that couple the tower light 512 to the base 520. In step 2, the electrical connections between the wagering game machine 510 and the first top-box mounted light fixture (e.g., tower light 520) are disconnected without opening the base cabinet 514 or top box 516 of the wagering game machine 510. Due to the simplicity in the design of the universal mounting base 520, all that is required to electrically disconnect the wagering game machine 510 from the tower light 520 is to detach the pigtail connector 528 from the mating connector 558. If the pigtail connector 528 were replaced with, for example, a blind mate connecter (e.g., blind mate connector arrangement 240 of FIG. 7), the tower light 520 is automatically electrically disconnected from the wagering game machine 510 when physically removed therefrom.

In step 3, an optional mounting plate 530 is provided and, in step 4, placed on top of the top box 516 such that a mounting hole 532 formed through a central region of the mounting plate 530 is aligned with the upper end of the mounting base 520. Bolt holes 534 in the mounting plate 530 must be aligned with complementary receiving holes 522 in the top box 516. Threaded fasteners are then passed through each bolt hole 534 and into a respective receiving hole 522, whereby the optional mounting plate 530 is rigidly attached to the top of the top box 516.

In step 5, all electrical connections between the wagering game machine 510 and a second, different top-box mounted display, namely marquee 540, are made without opening the base cabinet 514 or top box 516 of the wagering game machine 510. Due to the simplicity in the design of the universal mounting base 520, all that is required to electrically connect the wagering game machine 510 to the marquee 540 is to attach the pigtail connector 528 to the mating connector 558. Thereafter, the marquee 540 is attached to the cabinet top box 516 of the wagering game machine 510.

In some embodiments, the method of changing the appearance of a wagering game machine includes at least those steps enumerated above. It is also within the scope and spirit of the present disclosure to omit steps, include additional steps, and/or modify the order presented above. It should be further noted that the method represents a single change in appearance. However, it is expected, as indicated above, that the method be applied in a systematic and repetitive manner.

While the best modes for carrying out the present disclosure have been described in detail, those familiar with the art to which this disclosure relates will recognize various alternative designs and embodiments for practicing the disclosure within the scope of the appended claims.

The invention claimed is:

1. A gaming machine for playing a wagering game, the gaming machine comprising:

at least one display configured to display outcomes of the wagering game;

at least one input device configured to receive wagers from players; and a cabinet with:

a mounting base integrated to the top of the cabinet, the mounting base being configured to support a selected one of a plurality of different top-box mounted fixtures, each of the top-box mounted fixtures being at least partially structurally distinct from one another, and at least one electrical connector accessible from the exterior of the cabinet, the at least one electrical connector being configured to electrically connect the selected top-box mounted fixture to the cabinet.

2. The gaming machine of claim 1, wherein at least a portion of the at least one electrical connector projects upwardly from or is recessed into the top of the cabinet.

3. The gaming machine of claim 1, wherein the at least one electrical connector is a single electrical connector configured to electrically couple with any of the plurality of different top-box mounted fixtures.

4. The gaming machine of claim 1, wherein the at least one electrical connector comprises a pigtail connector protruding from the cabinet and configured to mate with a complementary electrical connecter of the selected top-box mounted fixture.

5. The gaming machine of claim 1, wherein the at least one electrical connector comprises a blind mate connector configured to automatically electrically couple the selected top-box mounted fixture to the cabinet when the selected top-box mounted fixture is physically mounted to the mounting base.

6. The gaming machine of claim 1, wherein the at least one electrical connector comprises a multi-point terminal block configured to mate with at least one complementary electrical connecter of the selected top-box mounted fixture.

7. The gaming machine of claim 1, wherein the mounting base includes a twist-lock assembly configured to mate with a corresponding twist lock structure of the selected top-box mounted fixture.

8. The gaming machine of claim 1, wherein the mounting base includes a telescoping support arm assembly configured to mate with a corresponding telescoping structure of the selected top-box mounted fixture.

9. The gaming machine of claim 1, wherein the cabinet includes a base cabinet with a top box vertically adjacent the base cabinet, and wherein the mounting base is integrated to the crown of the top box.

10. The gaming machine of claim 1, wherein the plurality of different top-box mounted fixtures comprises at least one tower light and at least one marquee display.

11. The gaming machine of claim 1, wherein the plurality of different top-box mounted fixtures comprises at least two different marquees each having a respective tower light.

12. The gaming machine of claim 1, further comprising:

at least one separator plate mounted on top of the cabinet and surrounding the mounting base, the at least one separator plate being configured to support a marquee display thereon.

13. A gaming machine for playing a wagering game, the gaming machine comprising:

at least one display configured to display outcomes of the wagering game;

at least one input device configured to receive a wager from a player; and a cabinet with a mounting base integrated to the top of the cabinet, the mounting base being configured to support a selected one of a plurality of different top-box mounted fixtures, each of the top-box mounted fixtures being at least partially structurally distinct from one another, wherein the mounting base comprises an inner support ring configured to receive and retain a tower light.

14. The gaming machine of claim 13, wherein the mounting base further comprises an outer support ring concentrically aligned with the inner support ring to define an annular slot therebetween, the annular slot being configured to receive a mounting post of a marquee display.

15. The gaming machine of claim 14, wherein the mounting post of the marquee display has an annular flange that seats on top of an upper support surface of the outer support ring.

16. A gaming system for playing at least one wagering game, the gaming system comprising:

at least one display configured to display an outcome of the at least one wagering game, the outcome being randomly determined from a plurality of wagering game outcomes;

at least one input device configured to receive a wager from a player to play the at least one wagering game;

at least one player input device configured to receive play input from the player;

a cabinet with a universal mounting base integrated to the top of the cabinet, the universal mounting base being configured to interchangeably support a selected one of a plurality of different top-box mounted fixtures, each of the top-box mounted fixtures being at least partially structurally distinct from one another; and at least one electrical connector accessible from the exterior of the cabinet, the at least one electrical connector being configured to electrically connect the selected one of a plurality of different top-box mounted fixtures to the cabinet.

17. The gaming system of claim 16, wherein the at least one electrical connector is integrated with the universal mounting base.

18. The gaming system of claim 17, wherein the at least one electrical connector is inside the universal mounting base.

19. The gaming system of claim 17, wherein the at least one electrical connector is outside of and adjacent to the universal mounting base.

20. The gaming system of claim 16, wherein the at least one electrical connector is configured to automatically electrically connect the selected top-box mounted fixture to the cabinet when the selected top-box mounted fixture is physically mounted to the universal mounting base.

21. A method of operatively attaching a selected one of a plurality of different top-box mounted fixtures on top of a wagering game terminal, the wagering game terminal including a cabinet, and the top-box mounted fixtures being at least partially structurally distinct from one another, the method comprising:

coupling, via at least one electrical connector accessible from the exterior of the cabinet of the wagering game terminal, all electrical connections between the selected one of the plurality of different top-box mounted fixtures and the wagering game terminal; and mounting the selected one of the plurality of different top-box mounted fixtures to the cabinet via a universal mounting interface integrated to the top of the cabinet, the universal mounting interface being capable of interchangeably supporting any of the plurality of different top-box mounted fixtures.

22. The method of claim 21, wherein the selected top-box mounted fixture is electrically coupled to the wagering game machine without opening the cabinet of the wagering game machine.

23. The method of claim 21, wherein the coupling and the mounting is substantially simultaneous.

24. A method of changing the appearance of a wagering game machine with a cabinet, the method comprising:

detaching a first of a plurality of different top-box mounted fixtures from a universal mounting base integrated to the top of the cabinet of the wagering game machine;

disconnecting electrical connections between an electrical connector accessible from the exterior of the cabinet of the wagering game machine and the first of the plurality of different top-box mounted fixtures without opening the cabinet of the wagering game machine;

connecting electrical connections between the electrical connector of the wagering game machine and a second of the plurality of different top-box mounted fixtures without opening the cabinet of the wagering game machine; and attaching the second of the plurality of different top-box mounted fixtures to the universal mounting base of the cabinet of the wagering game machine, wherein the first and second top-box mounted fixtures are at least partially structurally distinct from one another.

25. The method of claim 24, wherein the cabinet has a top box vertically adjacent a base cabinet, and wherein the plurality of different top-box mounted fixtures are mounted on top of the top box.

26. The method of claim 25, wherein the electrical connections between the wagering game machine and the first of the plurality of different top-box mounted fixtures are disconnected without opening the base cabinet or the top box of the wagering game machine.

27. The method of claim 26, wherein the electrical connections between the wagering game machine and the second of the plurality of different top-box mounted fixtures are connected without opening the base cabinet or the top box of the wagering game machine.

* * * * *